US005704152A

United States Patent [19]

Harrison et al.

[11] Patent Number: 5,704,152

[45] Date of Patent: Jan. 6, 1998

[54] SECURE, QUICK RELEASE SAFETY GUN LOCK

[75] Inventors: Martin Harrison, 6917 Altamira St., Coral Gables, Fla. 83146; Richard Becker; Tom Gill, both of Anaheim, Calif.

[73] Assignee: Martin Harrison, Coral Gables, Fla.

[21] Appl. No.: 735,417

[22] Filed: Oct. 22, 1996

[51] Int. Cl.[6] ..... F41A 17/00

[52] U.S. Cl. ..... 42/70.07

[58] Field of Search ..... 42/70.07, 70.06, 42/70.09

[56] References Cited

U.S. PATENT DOCUMENTS

| | | | |
|---|---|---|---|
| 3,085,360 | 4/1963 | Robbins | 42/66 |
| 3,164,919 | 1/1965 | Hall | 42/70 |
| 3,208,176 | 9/1965 | Giles | 42/66 |
| 3,352,047 | 11/1967 | McDonnell | 42/70 |
| 3,392,471 | 7/1968 | Foote | 42/70 |
| 3,422,559 | 1/1969 | Woloch | 42/66 |
| 3,422,560 | 1/1969 | Foote | 42/70 |
| 3,616,559 | 11/1971 | Sobolewski | 42/1 |
| 3,624,945 | 12/1971 | Foote | 42/1 Y |
| 3,738,042 | 6/1973 | Ruger et al. | 42/66 |
| 3,762,089 | 10/1973 | Meyer, Jr. | 42/70 F |
| 3,803,741 | 4/1974 | Ducommun | 42/66 |
| 3,956,842 | 5/1976 | Ballenger | 42/1 Y |
| 3,964,200 | 6/1976 | Patterson | 42/70 E |
| 3,978,603 | 9/1976 | Murabito | 42/66 |
| 3,979,850 | 9/1976 | Schiessal et al. | 42/71 P |
| 3,988,847 | 11/1976 | Kennedy | 42/66 |
| 4,084,341 | 4/1978 | Cervantes | 42/1 Y |
| 4,091,557 | 5/1978 | Murabito | 42/66 |
| 4,110,928 | 9/1978 | Smith | 42/66 |
| 4,136,475 | 1/1979 | Centille | 42/1 LP |
| 4,316,340 | 2/1982 | Kahn | 42/66 |
| 4,461,110 | 7/1984 | Inderbitzen | 42/66 |
| 4,461,111 | 7/1984 | Waiser | 42/66 |
| 4,499,681 | 2/1985 | Bako et al. | 42/1 Y |
| 4,509,281 | 4/1985 | Dreiling et al. | 42/1 Y |
| 4,621,445 | 11/1986 | Rohm | 42/66 |
| 4,680,884 | 7/1987 | Smith, Jr. | 42/66 |
| 4,761,906 | 8/1988 | Guevars | 42/70.11 |
| 4,763,431 | 8/1988 | Allan et al. | 42/70.11 |
| 4,769,936 | 9/1988 | Miller | 42/66 |
| 4,791,747 | 12/1988 | Ballenger | 42/66 |
| 4,825,576 | 5/1989 | Trocoso et al. | 42/70.07 |
| 4,833,811 | 5/1989 | Wilkinson | 42/70.08 |
| 4,852,286 | 8/1989 | Troncoso | 42/70.07 |
| 4,894,939 | 1/1990 | Perry | 42/66 |
| 4,912,867 | 4/1990 | Dukes, Jr. | 42/70.11 |
| 4,934,083 | 6/1990 | Smith | 42/70.07 |
| 4,972,618 | 11/1990 | Justice, Jr. | 42/70.11 |
| 5,437,119 | 8/1995 | Womack | 42/70.07 |
| 5,515,633 | 5/1996 | Harris | 42/70.07 |
| 5,535,605 | 7/1996 | Werner | 70/14 |

OTHER PUBLICATIONS

SAF T Lok Brochure & Order Form (7 pages).

Trigger Alarm (one page).

*Primary Examiner*—Charles T. Jordan

*Assistant Examiner*—Meena Chelliah

*Attorney, Agent, or Firm*—Curtis L. Harrington

[57] ABSTRACT

A gun lock utilizes an internal combination wheel which is advanced by the pressing of combination buttons which urge a combination wheel toward an unlock position. The unlocking of the gun lock enables a spring loaded rachet to be springingly urged quickly out of engagement with a main housing of the gun lock to enable the gun to be readily fired. The combination is set by the orientation and radial positioning of a series of angled blocks supported by the combination wheel. The combination setting for each advanced position of the wheel is based upon the combination wheel's position resulting from the prior movement in executing the previous combination number.

13 Claims, 7 Drawing Sheets

19
59
61
67
68
63
65
73
75
71
45
59
77
79
83
81
84
43
85
91
41
87
89
47
49
29
31
33
93
95
97
99
101
103

Fig. 11
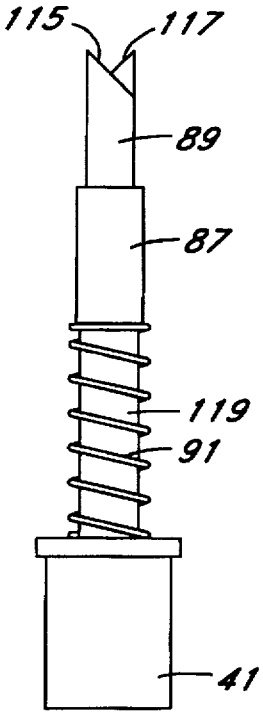
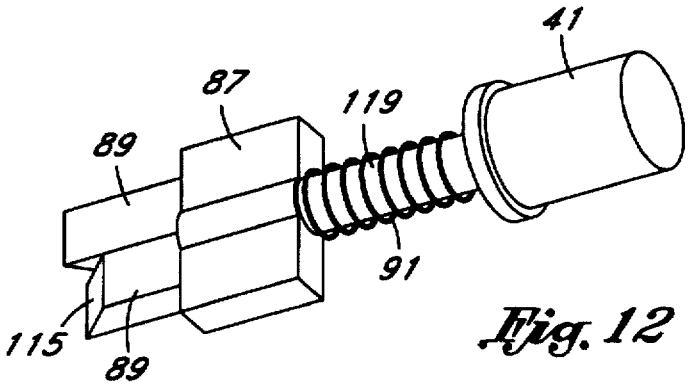
Fig. 12
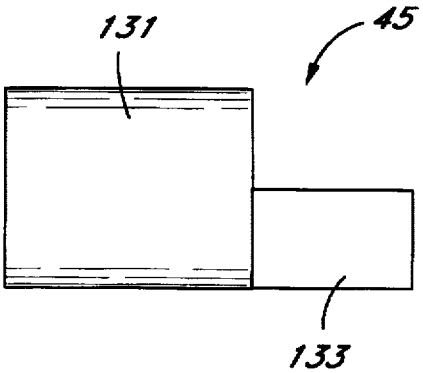
Fig. 16
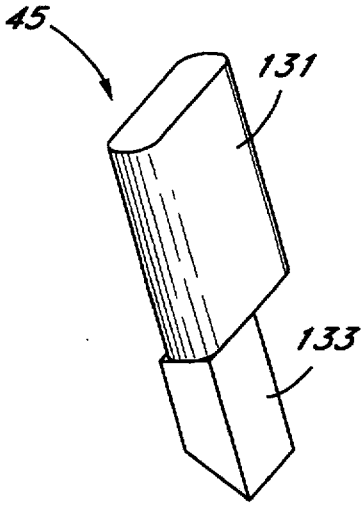
Fig. 17

SECURE, QUICK RELEASE SAFETY GUN LOCK

FIELD OF THE INVENTION

The present invention relates to the field of safety protection devices and more particularly to a gun lock device which has a wide range of combination programming capability to meet the needs of a user. More particularly, the gun lock has a wheel which has a progressive unlocking advance which is urged by pro-positionally fixed angled blocks which are positioned to set the combination of the lock.

BACKGROUND OF THE INVENTION

Conventional gun locks have a variety of configurations which act to prevent the unintended firing of a gun in a variety of ways. Some devices actually lock up the receiver and bore with a brightly colored structure to emphasize that the gun is disabled. This system and method works fine for guns during display at gun shows, but is not functional for situations where the gun is to be kept ready for defensive use and yet in a safe locked position to be kept from the unauthorized use, such as away from children, or perhaps to keep away the quick use of an intruder.

One of the most advantageous methods for disabling a gun, and particularly a hand gun is to prevent actuation of the trigger. A series of earlier conventional locks has employed a trigger guard lock with the use of a key. This structure and method works again works well for gun store display, and even for instances where the user has a large number of guns in a collection. However, for home protection, the key system is simply inadequate. The gun needs to be kept in an accessible place, and thus the need for a gun lock to prevent unwanted tampering. At the same time, the gun should be ready for defensive use as quickly as possible. The use of a key system simply will not work to achieve a workable goal. Where the key is kept near the locked weapon and the weapon is effectively not locked with respect to children and intruders. The presence of a key is a direct invitation to unlock the device, even for a small child.

Where the key is kept remotely from the locked gun, there may be insufficient time to unlock it in time. There is a further tendency to hide the key which makes it difficult to locate in an emergency. Further, there is a tendency to lose or misplace keys, which would make the weapon totally inaccessible in time of need.

Another lock available is a custom lock indended for certain types of firearms and which requires installation with a specialized mounting plate and partial grip, inaddition to an installation kit and a specialized lock module. This system is commercially available from SafTLok.

As such, there is currently no device which gives the access and safety which is needed in a gun lock. The needed device should not require a key or any other remotely locatable structure. The needed lock should be openable by a user, but not by others. Lastly, the degree of safety should be adjustable between uses where high safety is desired, such as where children are present, to a situation where a relatively lower degree of complexity in unlocking the lock is possible, especially in the case of an owner who lives alone or with other adults.

SUMMARY OF THE INVENTION

The improved gun lock utilizes an internal combination wheel which is advanced by the pressing of combination buttons toward an unlock position. The unlocking of the lock enables a spring loaded ratchet to be urged quickly out of engagement with the gun and the main body of the lock, to enable the gun to be readily fired.

The combination is set by the orientation and radial positioning of a series of angled blocks supported by the combination wheel. The combination setting for each advanced position of the wheel is based upon the combination wheel's position resulting from the prior movement in executing the previous combination number.

In some instances, the wheel may be reversed as well as advanced. This type of action can make the combination even more secure. Further, the number of combination entries can be varied, as can the possibility of retardation of the combination wheel, depending upon the desires of the user. In a preferred embodiment, there are five combination buttons. In instances where the user wants the quickest release combination, he can pre-set the lock to open upon the pressing of a single number of the lock a given number of times. This will provide for the quickest release. Alternatively, where children are normally present, the combination can be lengthened, especially since the lock can be preset to retard and advance the combination wheel.

BRIEF DESCRIPTION OF THE DRAWINGS

The invention, its configuration, construction, and operation will be best further described in the following detailed description, taken in conjunction with the accompanying drawings in which:

FIG. 11 is a side view of a button actuation assembly;

FIG. 12 is a perspective view of a button actuation assembly shown to emphasize construction as a first offset angled block portion adjacent a second offset angled block portion, on opposite sides of a midline and where the ends are angled in different positions;

FIG. 16 is a plan view of an angled block used with the combination wheel seen in FIG. 3;

FIG. 17 is a perspective view of the angled block shown in FIG. 16 and illustrating the sloped end surface;

DETAILED DESCRIPTION OF THE PREFERRED EMBODIMENT

Figures 1, 2:
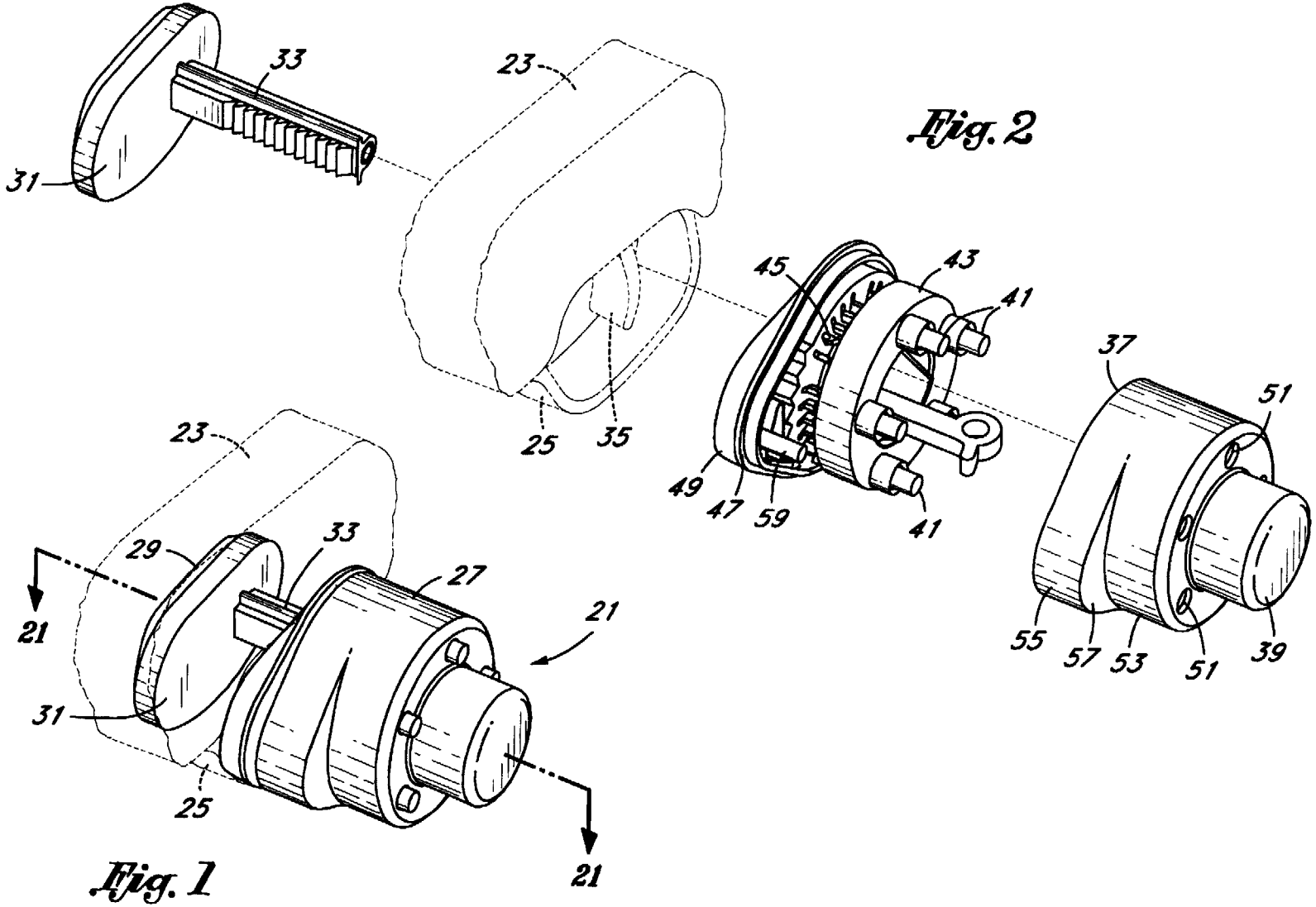
FIG. 1 is a perspective view of a gun lock of the present invention engaged with a section of a gun and trigger guard, both shown in phantom.
FIG. 2 is an exploded view of the gun lock shown in FIG. 1 and illustrating some of the details of the gun lock of the present invention.

The description and operation of the invention will be best begun as described with reference to FIG. 1. FIG. 1 illustrates a perspective view of a gun lock 21 in accord with the principles of the present invention in locked position with respect to a gun 23 having a trigger guard 25.

The lock has a main body 27 engages a locking portion 29. Locking portion 29 includes a side guard 31 supported by a ratchet stem 33. The ratchet stem 33 is secured by the main body 27 and the side guard 31 and the main body 27 prevents actuation of the trigger within the trigger guard 25.

Referring to FIG. 2, an exploded view illustrates further details of both the gun lock 21 and the gun 23. The gun 23 is shown as having a trigger 35. Note that the ratchet stem 33 fits behind the trigger 35 to further prevent movement of the trigger 35 into a position to fire the gun 23. Thus, the trigger is prevented from actuating the gun by virtue of the blocking positioning of the ratchet stem 33, as well as the blocking of the access to the trigger by the side guard 31 and the main body 27.

The one-sided predominance of the gun lock 21 makes it easier to manually find and actuate, particularly in darkened conditions. Referring to both FIGS. 1 and 2, the main body has a housing 37 with a prominent raised cylindrical portion 39. A series of buttons 41 are seen in FIG. 2 which protrude through the housing 37. The buttons operate axially through a stabilizer ring 43 to engage a series of angled combination wheel combination wheel block 45, a portion of some of the blocks seen in FIG. 2. The main portion 27 has a main support base 47 which further has an expanded portion 49 to better engage and fit within the trigger guard 25.

The raised cylindrical portion 39 not only helps identify and orient the user manually, but also provides a space into which the stem 33 may fit. It is contemplated for the lock 21 to fit as many different types of guns as possible. Where the trigger guard 25 is wide, the stem 33 will not penetrate as far into the housing 37. Where the trigger guard 25 is narrow, a greater penetration will occur and which will be facilitated by the raised cylindrical portion 39. Also, as will be seen, the raised cylindrical portion 39 forms a structure from which the locking portion 29 will be urged away from the main body 27 during unlocking of the lock 21.

Note that the housing 37 has a series of apertures 51 through which the series of buttons 41 protrude to enable the user to axially actuate them. Also not that the housing 37 has a large cylindrical portion 53 separated from a lobe 55 by a stepped portion 57. This stepped portion also helps the user to orient manually with respect to the lock 21 in dimly lit conditions. Also shown is one of two alignment pins 59 which are used to join and align the main support base 47 to the housing 37.

Figures 3, 4, 5:
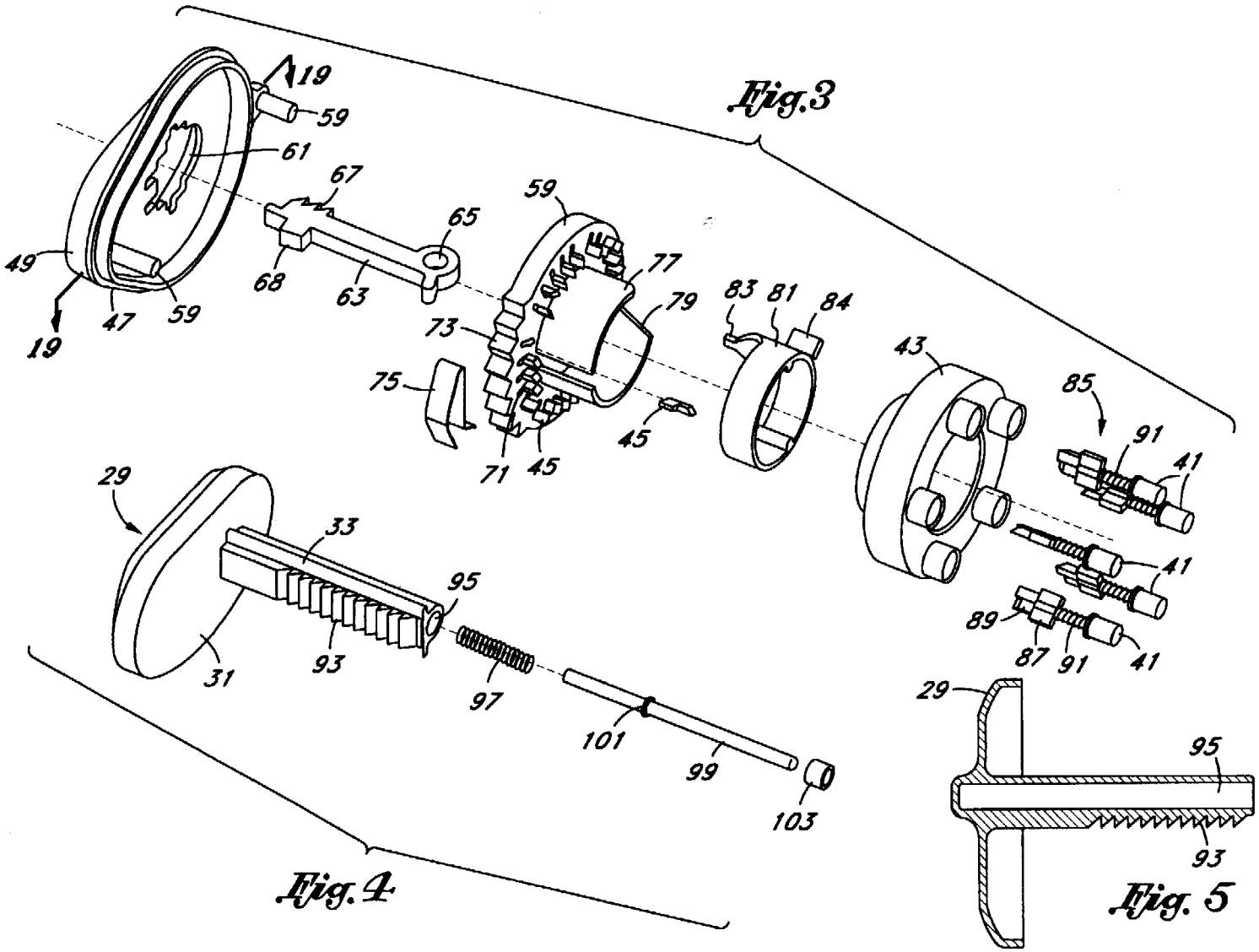
FIG. 3 is an exploded view of the main body of the gun lock and illustrating the combination wheel and main locking ratchet.
FIG. 4 is an exploded view of the locking portion shown in FIGS. 1 and 2 and illustrating the spring details which enable the locking portion to be urged away from the main body.
FIG. 5 is a cross sectional view of the locking portion shown in FIG. 4.

Referring to FIG. 3, an further exploded view of the gun lock 21 exposes even further details. Beginning at the left of FIG. 3, the main support base 47 is seen as having a pair of alignment pins for properly orienting and supporting the housing 37 to form an enclosed unit. The main support base 47 also has an entrance aperture 61 through which the stem 33 will pass as it enters the main body 27 to be secured during locking.

Just to the right side of the main support base 47 is shown a main locking ratchet 63 for engaging the rachet stem 33 and performing locking with respect to the locking portion 29. The main locking ratchet 63 has a main aperture 65 about which it is pivotally engaged by the housing 37. The main locking ratchet 63 also has a series of ratchet teeth 67 which will engage mating ratchet teeth on the ratchet stem 33 of the locking portion 29. Main locking ratchet 63 also contains a tab 68 which must have clearance in order for the main locking ratchet to swing backwards to the extent that the rachet teeth 67 may disengage from the ratchet stem 33.

To the right of the locking ratchet 63, the main combination wheel 69 is seen, and which supports the angled combination wheel combination wheel block 45 which are positioned to determine the combination which will release the gun lock 21 from a locked position. The main combination wheel 69 has a series of radial slots 71 which supports the angled combination wheel block 45 in either a radially inward or radially outward position. In addition, each of the angled combination wheel combination wheel block 45 can be oriented in either the clockwise or the counter clockwise position.

The main combination wheel 69 also has a series of detent structures 73 along the edge of a portion of its periphery. These structures 73 are shown as teeth but may be any such structures which aid in giving the main combination wheel a detent motion. Detent structures 73 interact with a detent spring 75 to insure that the main combination wheel 69 will have a series of stable positions throughout the circular range of its travel. Detent spring 75 will depend from a combination of the main support base 47 and possibly the housing 37. This prevents the combination wheel 69 from assuming a position which is half way along in its circular travels. This insures that the combination wheel 69 will only come to rest in a position where it can be further urged in its movement.

The main combination wheel 69 also has a raised split collar 77 each having a ramped edge 79 for interfitting with a reset ring 81 having a protruding tip 83, and an alignment tab 84. The alignment tab 84 permits the reset ring 81 to be axially displaced without a change in rotational alignment, and the alignment tab 84 extends outside of the housing 37 and is typically engaged by the thumb in order to reset the combination. To the right of the stabilizer ring 43, a series of actuation button assemblies 85, and including the buttons 41 are shown. Each of the actuation button assembles includes a block 87 supporting a double sloped block (one piece), or a pair of oppositely sloped blocks 89. In order to encourage orderliness in combination setting, it is preferred to orient the oppositely sloped blocks 89 in a consistent manner. With regard to FIG. 3, and looking to the left, toward the stabilizer ring 43, the oppositely sloped blocks are radially arranged so that the radially outward most block portions or blocks 89 are angled to face a clockwise direction while the inner most blocks 89 or block portions are angled to face in a counterclockwise direction.

This enables the angled combination wheel combination wheel block 45 which are supported by the main combination wheel 69 to be oriented to match this scheme. The angled combination wheel combination wheel block 45 which are radially outwardly located in the slots 71 have faces which are oriented counterclockwise to face the clockwise oriented faces of the blocks or block portion 89. This meeting of the faces provides the translation from an axial displacement of the buttons 41 and the button assemblies 85 into a clockwise circular motion of the main combination wheel.

Likewise, the angled combination wheel combination wheel block 45 which are radially inwardly located in the slots 71 have faces which are oriented clockwise to face the counterclockwise oriented faces of the blocks or block portion 89. This meeting of the faces provides the translation from an axial displacement of the buttons 41 and the button assemblies 85 into a counterclockwise circular motion of the main combination wheel.

The spacing between the slots 71 and the angled combination wheel combination wheel block 45 is important to create enough motion in any given direction that the detent spring 75 can complete the urging of the main combination wheel 69 to its next position. The force and interaction between any two angled surfaces of the angled block 45 and the angled blocks 89 being sufficient to place the combination wheel 69 in a position where the next pairs of interacting angled surfaces of angled block 45 and angled blocks 89 are ready to interact to again advance the combination wheel 69.

Each of the series of actuation block assemblies also has a spring 91 between the button 41 and the back end of the block 87. In operational position, the spring 91 will urge against the underside of the buttons 41 and against the stabilizer ring 43 to keep the buttons 41 in raised position when they are not being axially depressed to move the combination wheel 69.

Referring to FIG. 4, an exploded view of the locking portion 29 illustrates the presence of ratchet teeth 93. The end of the ratchet stem 33 has an elongate bore 95 which carries an ejection spring 97. Following the ejection spring 97 into the bore 95 is an ejection pin 99 having a raised annular ring 101. A retainer ring 103 is fixed within the end of the bore 95 and prevents the ejection pin 99 from coming completely out of the ratchet stem 33.

With the structure and forces shown, the ratchet stem 33 is inserted through the entrance aperture 61 and into the housing 37. As the ejection pin 99 begins to compress into the ratchet stem 33 the user must manually overcome the pressure from the ejection spring 97 to cause the rachet teeth 93 of the ratchet stem 33 to begin engagement with the ratchet teeth 67 of the main locking rachet 63. The ejection spring 97 provides the force for ejection of the locking portion 29 as soon as the gun lock 21 is unlocked to more rapidly facilitate removal of the lock 21 and the use of the gun.

Figure 6:
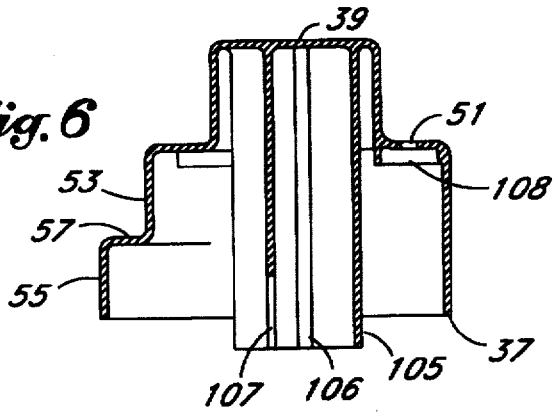
FIG. 6 is a cross sectional view of the housing shown in FIG. 1 and illustrating the structures in the central core.

Referring to FIG. 5, a cross sectional view of the locking portion 29 illustrates the extent to which the bore 95 extends through the ratchet stem 33. Referring to FIG. 6, a cross sectional view of the housing better illustrates the aperture 51. Since the there are five apertures 51 in the embodiment shown, no aperture appears opposite the aperture 51 shown in FIG. 6. FIG. 6 reveals a central core support 105 and having an elongate curved groove 106 running along the length of the central core support 105, which will be used to absolutely orient and slidably support the reset ring 81, as will be shown. The central core support 105 having an accommodation slot 107 shown in the lower portion thereof. As noted from FIG. 1, main locking ratchet 63 has a tab 68. The accommodation slot 107 is to accommodate the tab 68 during the unlocking procedure and when the main locking ratchet 63 swings away from engagement with the locking portion 29. As will be seen, the main combination wheel 69 will have an accommodation slot which aligns with the slot 107 to fully accommodate the tab 68 only during the unlocking process.

Also shown is a shallow internal boss 108 which surrounds the aperture 51. The shallow internal boss 108 assists in alignment with the raised structures carried by the stabilizer ring 43.

Figure 9:
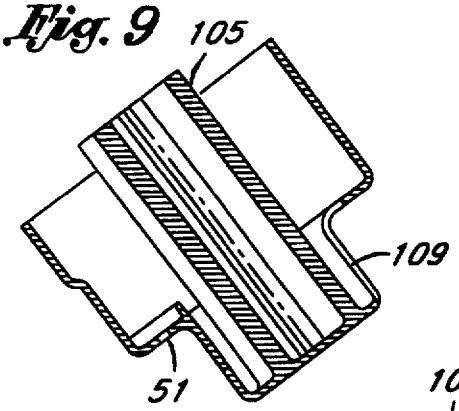
FIG. 9 is a further cross sectional view of the housing which taken to show the details of the alignment tab slot.
Figure 8:
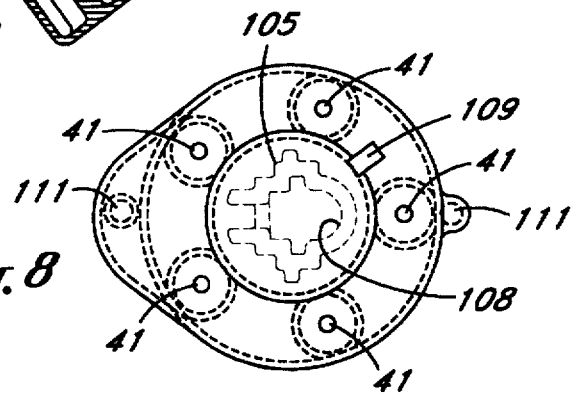
FIG. 8 is a top view of the housing shown in FIGS. 2, 6, and 7, and illustrating the internal details in phantom.

FIG. 8 is an end view looking straight atop the main body 27 and onto the housing 37. An alignment tab slot 109 is seen in position for the alignment tab 84 to protrude through it and thus outside the housing 37. Also can be seen the buttons 41 and other structures shown in dashed line format. The central core support 105 is seen with its central core aperture for accommodating the ratchet stem Referring to FIG. 9, a tab accommodation slot 109 is seen as cut into the prominent raised cylindrical portion 39 of the housing 37 to enable the alignment tab 84 to be pushed down with the thumb to reset the position of the main combination wheel 69 in the event that the user accidentally punches the wrong combination button. Even where the user is unable to identify the which button was mis-pressed, when the lock fails to open, it can be quickly re-set to a start position with a simple depression of the finger or thumb.

Figure 10:
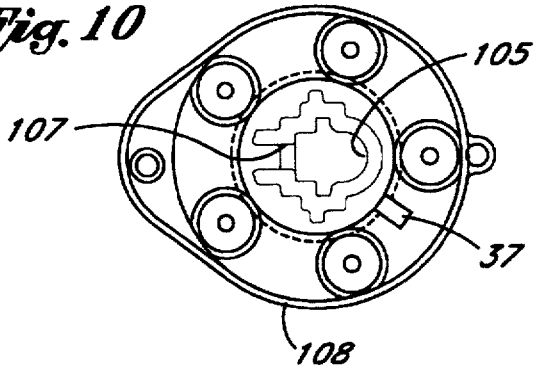
FIG. 10 is a bottom of the housing shown in FIGS. 2, 6, and 7, and illustrating the internal details.
Figure 7:
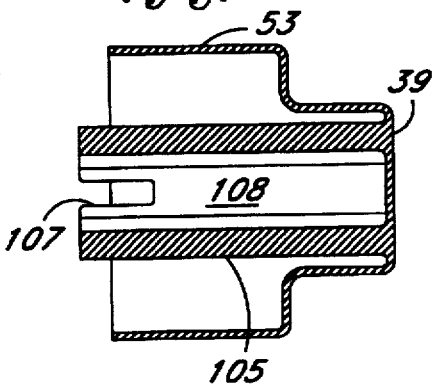
FIG. 7 is a further cross sectional view of the housing shown in FIG. 6 but taken from an orthogonal perspective.

Referring to FIG. 10, an underside view of the housing 37 is shown. In FIG. 10, and also as shown in FIG. 8 in dashed line format, a pair of alignment pin apertures 111 are shown which engage and interfit with the alignment pins 59 to strengthen and align the main body 27. Also revealed is the three dimensional nature of the accommodation slot 107. Also better seen is the slot for the alignment tab 84.

Referring to FIG. 11, a closeup view of the actuation button assembly 85 illustrates further details thereof. The angled blocks 89 have angled surfaces 115 and 117. The block 89 closest to the observer has angled surface 115 while its adjacent block 89 has an angled surface 117. As can be seen, engagement with surface 115 would urge an opposing object away from the surface 115 to the right, while engagement with surface 117 would urge an opposing object away from the surface 117 and to the left.

The spring 91 surrounding a main cylindrical portion 119 of the actuation button assembly 85 will abut structures shown on the stabilizer ring 43 to be discussed later. FIG. 12 illustrates a perspective view of the actuation button assembly 85 to give a better idea of its overall shape.

Figure 13:
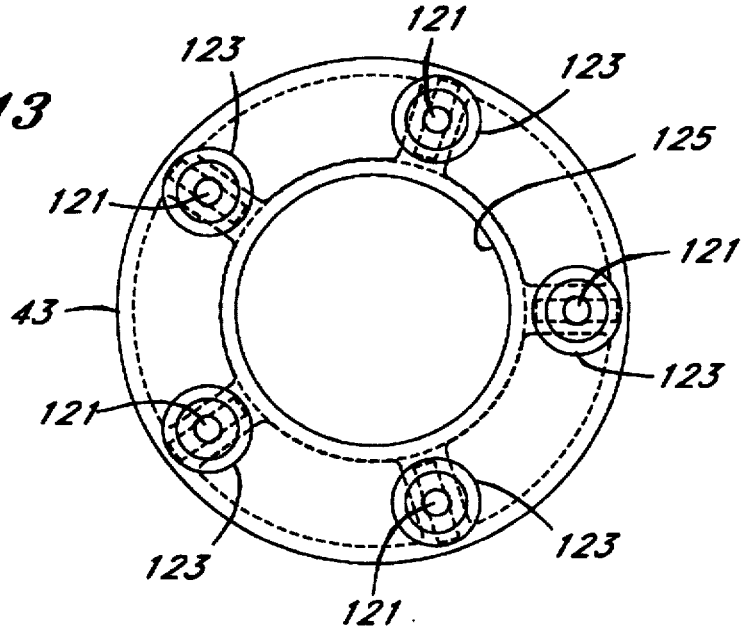
FIG. 13 is an upper view of a stabilization ring and illustrating the surface which faces the end portions of the housing shown in FIG. 2 and illustrating circular bosses which receive the button portion of the actuation button assemblies used to actuate the gun lock.

FIG. 13 illustrates an upper view of the stabilizer ring 43 shown in FIG. 1. The stabilizer ring 43 has a series of apertures 121 through which the main cylindrical portion of the actuation button assemblies 85 will be slidably supported. Surrounding each of the apertures 121 is a hollow annular member 123 which surrounds the compression of the springs 91 when the actuation button assemblies 85 are depressed. Further, when the buttons 41 are depressed, the lower end of the buttons 41 ride within the hollow annular members 123.

Note that stabilizer ring 43 has an internal surface 125 of sufficient diameter to enable it to fit over the split rings 77 and 79 of the main combination wheel 69. This enables the reset ring 81 to work within the internal surface 125 and for the stabilizer ring 43 to adequately support and axially maintain and support the reset ring 81.

Figure 14:
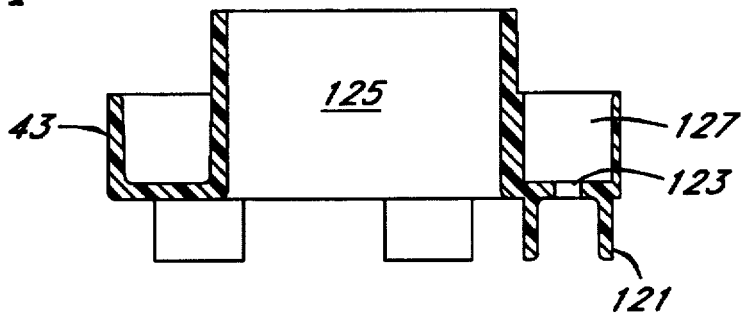
FIG. 14 is a side sectional view of the stabilization ring shown in FIG. 13.

Referring to FIG. 14, a cross sectional view of the stabilizer ring 43 illustrates a cross sectional look at one of the apertures 121 and structures surrounding it. On one side of the stabilizer ring 43 is shown the hollow annular member 123. On the other side is shown a rectangular annular member 127. The rectangular annular member 127 is sized to accommodate the rectangular structures of the actuation button assemblies 85, and including the block 87 and pair of oppositely sloped angled blocks 89.

Figure 15:
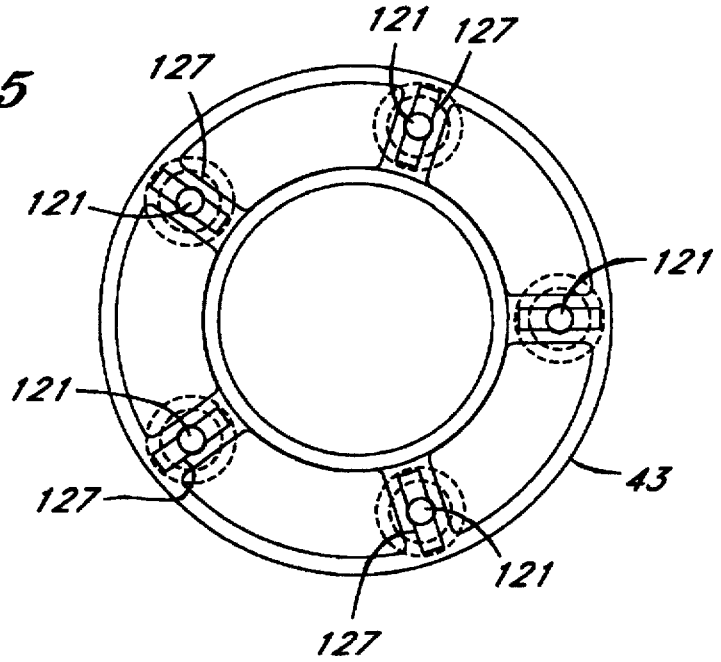
FIG. 15 is an underside view of a stabilization ring and illustrating the surface which faces the combination wheel and illustrating rectangular bosses which receive the block portion of the actuation button assemblies.

Referring to FIG. 15, a view of stabilizer ring 43 opposite from the view shown in FIG. 13 clearly illustrates the rectangular annular members 127. As can be seen, the rectangular structures of the actuation button assemblies 85, and including the block 87 and pair of oppositely sloped angled blocks 89 will be supported on all sides as they are axially urged to work the combination of the lock 21 of the present invention.

Referring to FIG. 16, the combination wheel block 45 is shown as a one piece structure consisting of a base member 131 and an upper offset angled block 133. Because the offset angled block 133 is completely offset to one side, it can be used both as a radially outwardly located block as well as a radially inwardly located block simply by reversing its position in slot 71. This is a more stable configuration than having a narrow combination wheel block which would be slidable within the slot 71, and which might fall out of alignment, especially due to the pushing and angled forces applied to it. FIG. 17 is a perspective view of the combination wheel block 45 showing a better three dimensional rendering.

Figure 18:
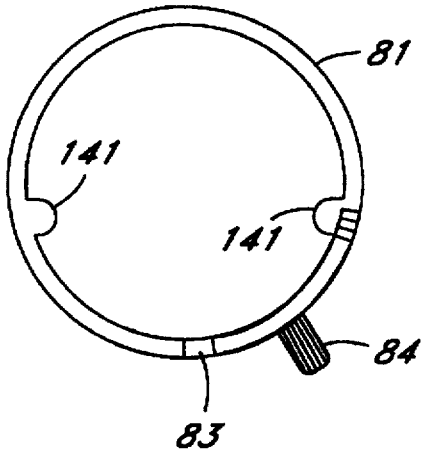
FIG. 18 is an axial view of a reset ring in the direction of its protruding tip.

Referring to FIG. 18, an axial view into the reset ring 81 of the present invention is shown. The reset ring 81 has a pair of internally disposed ribs 141 which engage the curved grooves 106 of the central core support 105. Note that the ribs 141 are not evenly radially separated. This insures that the reset ring 81 can fit along the central core support 105 in just one radial orientation. This further insures that the gun lock 21 will be exactly reset each and every time upon actuation of the alignment tab 84.

Figure 19:
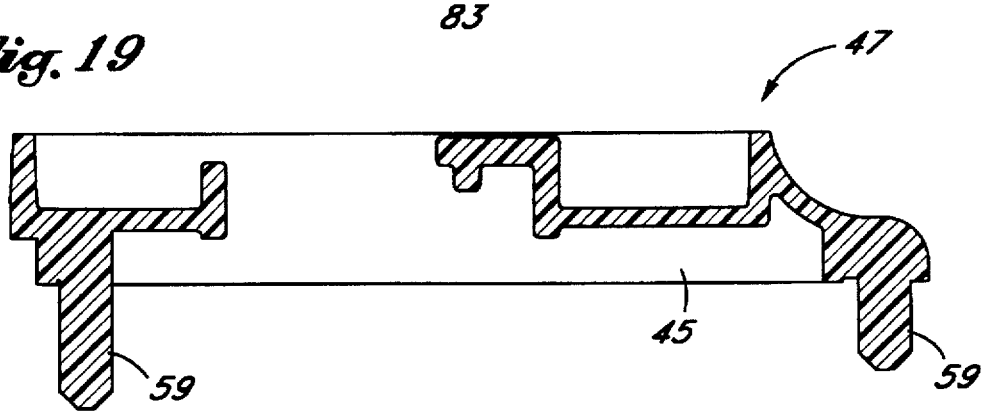
FIG. 19 is a cross sectional view of the main support base 47 shown in FIG. 3 and illustrating its alignment pins.

Referring to FIG. 19, a sectional view taken along line 19—19 of FIG. 1 illustrates a sectional view of the main support base 47. An accommodation space 145 is fitted to accept and enable rotation of the main combination wheel 69, and no other structure to support even rotation is necessary.

Figure 20:
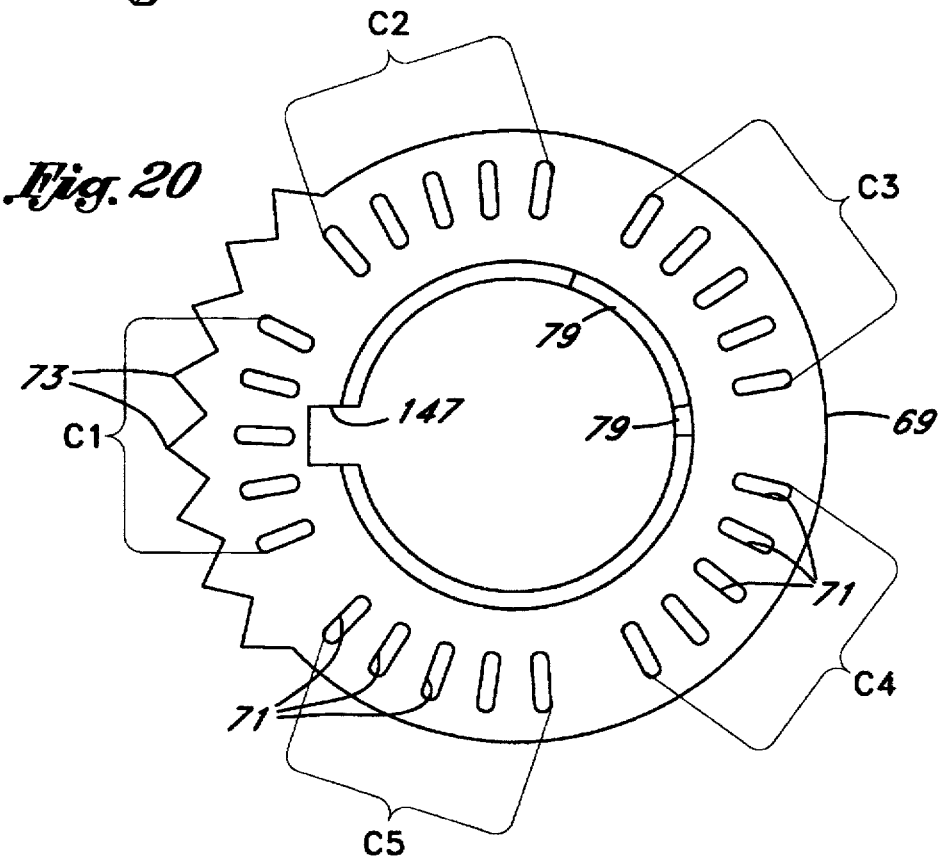
FIG. 20 is an axial view of the combination wheel shown in FIG. 3 and emphasizing a series of radial slots into which the angled blocks will fit to constitute the combination of the gun lock.

Referring to FIG. 20, an axial view of FIG. 20 illustrates that the series of radial slots are grouped in radial section groupings of five. Also shown for the first time is a locking ratchet 63 release slot 147. When the main combination wheel 69 is turned to the extent that the release slot 147 aligns with the locking ratchet 63, the locking ratchet 63 is released to free the locking portion 29. The locking ratchet 63 may be spring urged into an unlock position so that when alignment occurs, a spring will instantly urge it open. Alternatively, the natural springing force of the locking ratchet 63 may be used. The force to hold the locking ratchet 63 against the ratchet teeth 93 of the ratchet stem 33 may come from slight deformation of the locking ratchet itself. Choice of the manner of urging unlocking disengagement will depend upon the materials of choice. It is also understood that even though the main combination wheel is shown as having a single contiguous set of detent structures 73 that two radially opposite sets of such teeth could be used, along with a second opposing detent spring 75.

Figure 21:
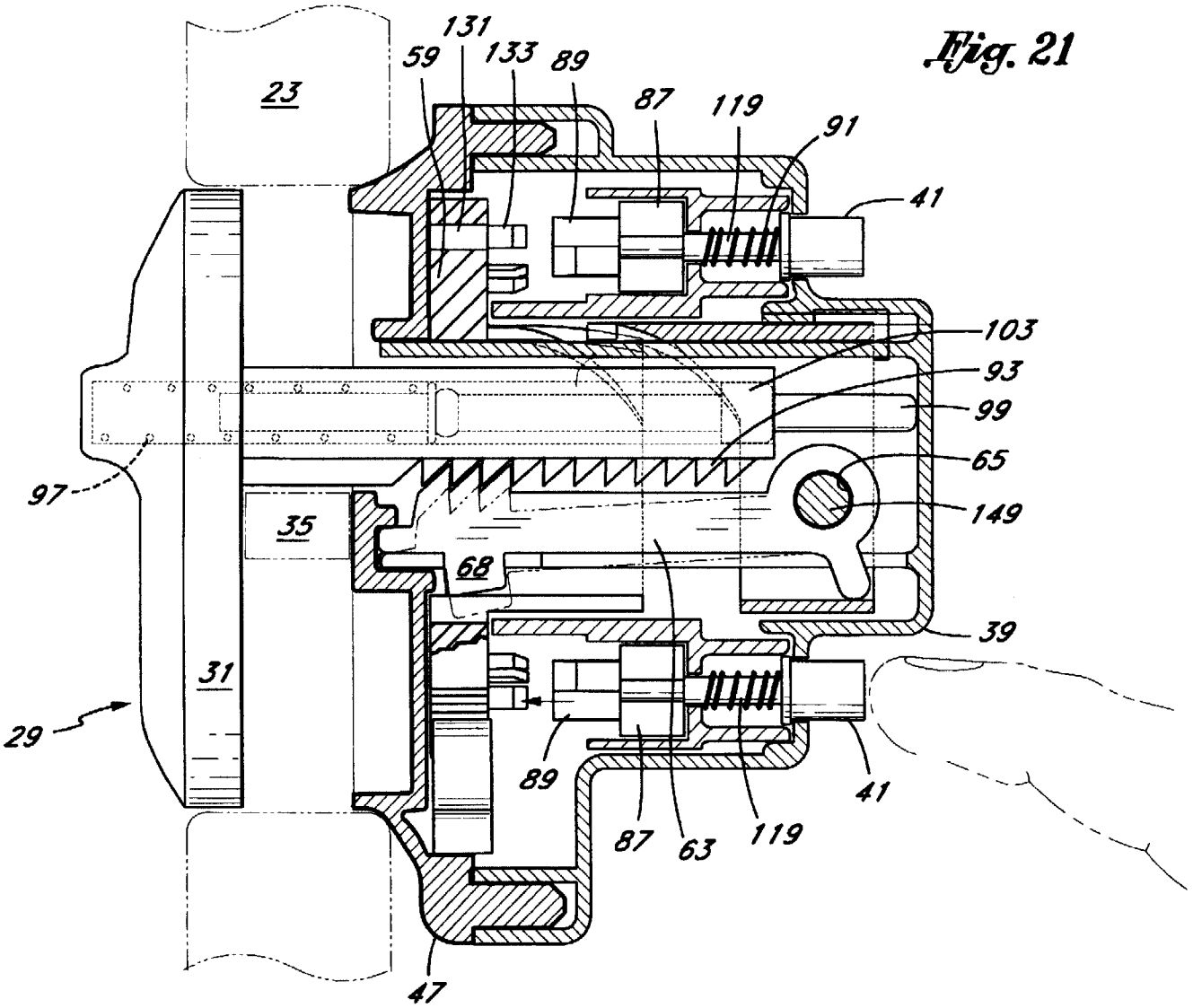
FIG. 21 is a sectional view taken along line 21—21 of FIG. 1 and illustrating the workings of the gun lock of the present invention.

Referring to FIG. 21, a sectional view taken along line 21—21 of FIG. 1 illustrates the full workability of gun lock 21. Here is seen a pivot axle 19 which fits through main aperture 65 of the main locking ratchet 63. The pivot axle can be either jam fit or slidably fit into the internal spaces defined within the housing 37. Alternately, a pair of axle portions can accommodate the main locking ratchet 63 in a snap fit portion. Regardless of the method of affixation, the main locking ratchet 63 must move freely within the housing 37 so that it can be pivoted instantly to the unlock position once the proper combination is actuated.

Referring back to FIG. 20, the operation of the gun lock 21 is first begun by "programming" a combination. The main combination wheel 69 can be any configuration, but is shown as divided into five sections with each section having a single set of radial slots. As can be seen from the series of detent structures 73, the main combination wheel 69 is only intended to travel a short distance between the fully locked and the unlock position.

Further, each set of five slots will ideally pass underneath one of the button 41 position during the travel of the main combination wheel 69. The illustration of the physical divisions on the main combination wheel 69 simplify both the understanding and setting of the combination. With this configuration, the series of radial slots 71 will not be located beneath one of the button 41 positions and then pass underneath another button 41 position. In this case, the "range" of radial slots 71 to be considered for each button 41 position would overlap and the programming of the gun lock 21 would be slightly more complicated.

The main combination wheel 69 could have been made of a greater or lesser number of sets of radial slots 71 than five, and each of the sets could have included a greater or lesser number of radial slots 71 within each set. The numbers of sets selected for illustration herein are believed to constitute an optimum workability given the size of the gun lock 21 and its relationship to the size of trigger guard 25 with which the gun lock 21 is fitted. It is also contemplated that the gun lock 21 can be custom made and fitted for different shapes and types and sizes of trigger guard 25, as well as different relative placements of the trigger 35 to be taken account of in the design of the gun lock 21.

In its simplest terms, the main combination wheel 69 must be rotated into position from a starting point. Assuming that the starting point is in a position more closely associated with the end one of the series of radial slots 71 and will end at one of the series of radial slots 71 at the other end of the series of radial slots in the same group, the combination strategy first discussed will assume no intentional reversal of the main combination wheel. Further, and for clarity, we will assume that the main combination wheel 69 will proceed clockwise.

Assuming that the main combination wheel 69 will proceed over five turns to the right to an unlock position, it is clear that any of the five sets of slots can be used to actuate the main combination wheel 69. When a single one of the five sets of radial slots 71 is used to move the main combination wheel 69 forward, a corresponding one of the combination buttons 41 are used.

In FIG. 20 each set of five radial slots 71 has been group labeled C1, C2, C3, C4, and C5. Each group corresponds to a single one of the buttons 41, and the buttons 41 may be labeled in accordance with this scheme. In a most simple case, consider the group C1. Where a gun owner wants quick access to an unlock position, he may want the gun lock 21 to unlock by depressing a single one of the buttons 41 five times to give the unlock position. Assuming that he wants to use the button 41 associated with the C1 group, five of the angled blocks 45 will be placed in a position so that the upper offset angled block 133 is to the radially outer portion of the series of radial slots 71 within the group C1. This will advance the wheel by one position each time the button 41 which overlies the C1 group is actuated.

If the angled blocks 45 are omitted from all other radial slots 71 in the other groups C2, C3, C4 and C5, the actuation of buttons 41 over those groups will have no effect. Again, remember the assumption here is that a clockwise displacement moves the main combination wheel 69 toward an unlock position. If the main combination wheel 69 were configured to move in counterclockwise motion to unlock, the angled blocks 45 would have been be placed in a position so that the upper offset angled block 133 is to the radially inward portion of the series of radial slots 71 within the group C1. The examples illustrated herein, for clarity will continue assuming the clockwise mode.

As a further deterrent, and building upon the first example where five depressions of the C1 group cause the gun lock 21 to open, certain ones of the angled blocks 45 can be placed under buttons 41 in the other groups C2, C3, C4, and C5. In the most extreme case, the other series of radial slots 71 can be filled with angled blocks 45 arranged such that the upper offset angled block 133 is to the radially inward portion of all other of the series of radial slots 71, such that actuation of any button 41 (other than the single button 41 associated with the C1 group) would cause the main combination wheel to reverse by one position for each of the other buttons depressed.

This action would cause the same "feel" to be experienced for each depression of any of the buttons 41, since the depression of any button 41 would cause the series of detent structures 73 to be urged past the detent spring 75. Alternatively some of the angled blocks 45 could be present and some absent from the series of radial slots 71 in a random fashion.

The next more complex manner of programming is to set up a more complex combination, where the angled blocks 45 completely fill the series of radial slots 71 within all of the groups, but where only one of the angled blocks 45 is positioned within each group which will urge the main combination wheel 69 in the clockwise direction. For example, where the combination involves the clockwise actuation of the buttons 41, starting with the button 41 associated with the C1 group, the most clockwise of the series of radial slots 71 within the group C1 would have an angled blocks 45 placed in a position so that the upper offset angled block 133 is to the radially outward portion that slot 71 in order to advance the main combination wheel 69 in a clockwise direction. All other angled blocks 45 within the C1 group would placed in a position so that the upper offset angled block 133 is to the radially inward portion that depression of the button 41 over the C1 group will only cause the main combination wheel 69 to reverse its direction and take the gun lock 21 a further step away from the unlock position.

In group C2, the second most clockwise of the series of radial slots 71 within the group C2 would have an angled blocks 45 placed in a position so that the upper offset angled block 133 is to the radially outward portion of that slot 71 in order to advance the main combination wheel 69 in a clockwise direction, but only when the main combination wheel 69 has been moved to its second position. All other of the angled blocks 45 within the C2 group would placed in a position so that the upper offset angled block 133 is to the radially inward portion that depression of the button 41 over the C2 group will only cause the main combination wheel 69 to reverse its direction and take the gun lock 21 a further step away from the unlock position. With respect to the C2 group advancement of the main combination wheel 69 will only occur when the main combination wheel is in the second position.

In the third group C3, the third most clockwise of the series of radial slots 71 within the group C2 would have an angled blocks 45 placed in a position so that the upper offset angled block 133 is to the radially outward portion of that slot 71 in order to advance the main combination wheel 69 in a clockwise direction, but only when the main combination wheel 69 has already been moved to its third position. All other of the angled blocks 45 within the C2 group would placed in a position so that the upper offset angled block 133 is to the radially inward portion that depression of the button 41 over the C2 group will only cause the main combination wheel 69 to reverse its direction and take the gun lock 21 a further step away from the unlock position. The same scheme is to be followed with respect to the groups C4 and C5.

Of course, the sequence from group C1 to C2, C3, C4, and C5 need not be followed. The sequence can change, for example C5, C2, C3, C4 and C1. Further, more than one grouping or button may be used in the sequence, to the exclusion of others. An example of this might be C2, C4, C2, C4, C5. In any instance where the user enables a pair of forward urging angled block 45 to be placed in the same position in two different groups, the combination will be retrograde in that it would allow either of two different buttons to be pressed to move the main combination wheel 69 forward at a particular sequence in the combination. Thus the combination sequence might be C1, C2 or C5, C4, C3, and C5.

Thus the user can set the combination to a single button per advance configuration or to multiple button/advance configurations. It is of course recommended that where children are in a position to potentially have access to the gun that the combination be a random specific progression of button 41 pushes.

Also, five such combination buttons 41 are shown and represent what is believed to be one of the more dense combinations desired given the average size of a trigger guard 25. Fewer combinations of buttons 41 may be more desireable, and in a north-south-east-west configuration. Orientation of the location of the buttons 41 to a reference could be accomplished by raised cross located on the planar surface of the prominent raised cylindrical portion 39, or by other orientational marking or protrusions.

Further, the orientation of the gun lock 21 and the feel of the buttons 41 and the prominent raised cylindrical portion 39 allow the gun lock 21 to be operated in dimly lit conditions. By manually orienting the gun 23, a user can manipulate the combination even in complete darkness. The use of five buttons 41 enables a fairly easy manual identification of the buttons 41 by their radial position about the prominent raised cylindrical portion. Where only four or three buttons 41 are used, the manual identification process can be even simpler. Further, depending upon the programming, some of the buttons 41 can be left in an unused state to enable the user to only have to concentrate only on certain buttons, such as the original example where the user presses only the button 41 associated with the C1 group.

Other preferred settings for the combination wheel contemplate that a range of motion for the combination wheel 69 might be provided which is greater than the displacement strictly from a zero or start position then to an unlock position. Where this is the case, and before any actuation or sequence of actuation, where the combination wheel 69 is reversed to a position "behind" the first position, the combination wheel 69 should ideally be configured to lie in a "dead zone" where further operation of the combination buttons 41 will no longer actuate the combination wheel 69 at all. The same configuration and result should occur if for any reason the combination wheel 69 were advanced to a position beyond the release position, a "dead zone" condition should also exist where further operation of the combination buttons 41 will no longer actuate the combination wheel 69 at all. Where the gun lock 21 portions which separate are spring loaded, the occurrence of the last condition is unlikely. These "dead zone" configurations will help to prevent breakage for actuations where the combination wheel 69 has no other options for movement at the end of its travel, and where actuation of combination button 41 might be against a combination wheel 69 which cannot move, for example, where the main locking ratchet 63 has entered and remains in release slot 147, the combination wheel 69 cannot move. In this configuration, actuation of a combination button 41 could damage any of the force linking structures between the combination button 41 and the combination wheel 69.

While the present invention has been described in terms of a gun lock for use with the trigger guard and trigger of any gun, including a hand gun, one skilled in the art will realize that the structure and techniques of the present invention can be applied to many similar appliances. The present invention may be applied in any situation where an actuation lever such as a trigger needs to be enclosably locked with a system which provides maximum user programmability.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A gun lock for isolating and preventing actuation of a trigger comprising:

a locking portion having a side guard attached to a ratchet stem;

a main body further comprising:

a main support base having an entrance aperture for receiving said ratchet stem and for support;

housing engaging said main support base;

a combination wheel rotatably supported by said main support base, and within said housing, moveable between a finite number of quantified rotational positions;

a main locking ratchet engagable with said ratchet stem when said ratchet stem is inserted through said aperture;

a reset wheel axially actuatable toward and away from said combination wheel to reset the rotational position of said combination wheel;

means for angularly displacing said combination wheel only between said finite number of quantified rotational positions to cause said main locking ratchet to disengage from said ratchet stem, wherein said means for angularly displacing said combination wheel only between said finite number of quantified rotational positions further comprises:

a plurality of actuation button assemblies slidably axially supported by said housing, each having a button end and an angled block end directed in a first direction;

a series of combination wheel angled blocks supported by said combination wheel, and directed in a second direction opposite from said first direction, said combination wheel angularly displaced when said angled block ends of said actuation button assemblies engage said combination wheel angled blocks.

2. The gun lock as recited in claim 1 wherein each of said combination wheel angled blocks further comprises:

a base member having an overall width and a midline; and an offset angled block, attached to said base member of about half of said overall width of said base member and lying to one side of the midline of said base member, said offset angled block having an end opposite said base member angled with respect to the axial length of said offset angled block.

3. The gun lock as recited in claim 1 wherein said angled block end of each of said plurality of actuation button assemblies includes a first offset angled block portion adjacent a second offset angled block portion and lying on opposite sides of a midplane of aid angled block and wherein said first offset angled block portion has an end angled in a first direction parallel to said midplane and wherein said second offset angled block portion has an end angled in a second direction parallel to said midplane and different than said first direction.

4. The gun lock as recited in claim 1 and further comprising:

a stabilizer ring supported by said main support base and said housing and having a series of radially distributed apertures for slidably supporting said plurality of actuation button assemblies and for limiting the axial extend to which each actuation button assembly may be axially actuated.

5. The gun lock as recited in claim 4 wherein said stabilizer ring has an upper boss within which the button end of said actuation button assembly is slidably axially supported, and a lower boss within which the angled block end of said actuation button assembly is slidably axially supported.

6. The gun lock as recited in claim 4 and further comprising:

a collar carried by said main combination wheel and having a ramped edge;

a reset ring carried within said stabilizer ring and having a protruding tip which is engageable with said ramped edge to reset said main combination wheel to a starting position.

7. The gun lock as recited in claim 6 wherein said reset ring carries an alignment tab which protrudes through said housing and may be manually axially displaced to reset said main combination wheel.

8. The gun lock as recited in claim 1 wherein said combination wheel has a series of radially distributed radial slots, and said combination wheel angled blocks supported by said combination wheel interfit within said series of radially distributed radial slots.

9. The gun lock as recited in claim 8 wherein said radially distributed radial slots are radially grouped into groups of five.

10. The gun lock as recited in claim 1 wherein said combination wheel angled blocks have a base member having a midplane at the center thereof and also have an offset angled block to one side of said midplane.

11. A gun lock for isolating and preventing actuation of a trigger comprising:

a locking portion having a side guard attached to a ratchet stem;

a main body further comprising:

a main support base having an entrance aperture for receiving said ratchet stem and for support;

housing engaging said main support base;

a combination wheel rotatably supported by said main support base, and within said housing, moveable between a finite number of quantified rotational positions;

a main locking ratchet engagable with said ratchet stem when said ratchet stem is inserted through said aperture;

a reset wheel axially actuatable toward and away from said combination wheel to reset the rotational position of said combination wheel;

means for angularly displacing said combination wheel only between said finite number of quantified rotational positions to cause said main locking ratchet to disengage from said ratchet stem, and wherein said ratchet stem of said locking portion defines an elongate aperture and further comprises:

a spring carried within said elongate aperture;

an ejector pin carried within and axially displaceable with respect to said elongate aperture and compressing said spring and having a circular raised land; and a locking collar carried within said elongate aperture and adjacent an opening of said aperture to limit movement of said ejector pin out of said elongate aperture.

12. A gun lock for isolating and preventing actuation of a trigger comprising:

a locking portion having a side guard attached to a ratchet stem;

a main body further comprising:

a main support base having an entrance aperture for receiving said ratchet stem and for support;

housing engaging said main support base;

a combination wheel rotatably supported by said main support base, and within said housing, moveable between a finite number of quantified rotational positions;

a main locking ratchet engagable with said ratchet stem when said ratchet stem is inserted through said aperture:

a reset wheel axially actuatable toward and away from said combination wheel to reset the rotational position of said combination wheel;

means for angularly displacing said combination wheel only between said finite number of quantified rotational positions to cause said main locking ratchet to disengage from said ratchet stem, and wherein said combination wheel carries a series of detent structures and said gun lock further comprises a detent spring supported by said main body which engages said detent structures to urge said combination wheel into a plurality of quantified rotational positions.

13. A gun lock for isolating and preventing actuation of a trigger comprising:

a locking portion having a side guard attached to a ratchet stem;

a main body further comprising:

a main support base having an entrance aperture for receiving said ratchet stem and for support;

housing engaging said main support base;

a combination wheel rotatably supported by said main support base, and within said housing, moveable between a finite number of quantified rotational positions;

a main locking ratchet engagable with said ratchet stem when said ratchet stem is inserted through said aperture;

a reset wheel axially actuatable toward and away from said combination wheel to reset the rotational position of said combination wheel;

means for angularly displacing said combination wheel only between said finite number of quantified rotational positions to cause said main locking ratchet to disengage from said ratchet stem, and wherein said main locking ratchet has a main aperture near a first end and a tab oppositely disposed with respect to a series of main locking ratchet teeth at a second end and wherein said main combination wheel has a release slot which accommodates said tab when said main combination wheel is moved to the unlock position.

* * * * *